US008617417B2

(12) United States Patent
Inaba et al.

(10) Patent No.: US 8,617,417 B2
(45) Date of Patent: Dec. 31, 2013

(54) CLEANING COMPOSITION, METHOD FOR PRODUCING SEMICONDUCTOR DEVICE, AND CLEANING METHOD

(75) Inventors: Tadashi Inaba, Haibara-gun (JP); Kazutaka Takahashi, Haibara-gun (JP); Tomonori Takahashi, Haibara-gun (JP); Atsushi Mizutani, Haibara-gun (JP)

(73) Assignee: FUJIFILM Corporation, Tokyo (JP)

( * ) Notice: Subject to any disclaimer, the term of this patent is extended or adjusted under 35 U.S.C. 154(b) by 17 days.

(21) Appl. No.: 13/107,199

(22) Filed: May 13, 2011

(65) Prior Publication Data

US 2011/0281436 A1 Nov. 17, 2011

(30) Foreign Application Priority Data

May 14, 2010 (JP) ..... 2010-111885

(51) Int. Cl.
*C09K 13/00* (2006.01)

(52) U.S. Cl.
USPC ..... 252/79.4; 252/79.1; 438/745; 216/103; 134/1.1

(58) Field of Classification Search
USPC ..... 252/79.1, 2, 3, 4, 79.2, 79.3, 79.4; 438/745, 750; 216/83, 103; 134/1.1, 134/1.2
See application file for complete search history.

(56) References Cited

U.S. PATENT DOCUMENTS

| | | | | |
|---|---|---|---|---|
| 5,929,016 | A * | 7/1999 | Harrison | 510/384 |
| 7,375,066 | B2 * | 5/2008 | Kakizawa et al. | 510/175 |
| 2005/0287480 | A1 * | 12/2005 | Takashima | 430/331 |
| 2006/0094614 | A1 | 5/2006 | Honda et al. | |
| 2010/0152086 | A1 * | 6/2010 | Wu et al. | 510/175 |

FOREIGN PATENT DOCUMENTS

| | | | |
|---|---|---|---|
| JP | 3219020 | B2 | 10/2001 |
| JP | 3850039 | B2 | 11/2006 |
| WO | 9836045 | A1 | 8/1998 |

OTHER PUBLICATIONS

Extended European Search Report dated Oct. 7, 2011 issued in corresponding European Patent Application No. 11166033.8.

* cited by examiner

*Primary Examiner* — Lan Vinh
(74) *Attorney, Agent, or Firm* — Sughrue Mion, PLLC

(57) ABSTRACT

Provided are a cleaning composition which is capable of inhibiting the metal of a semiconductor substrate from corrosion, and has an excellent removability of plasma etching residues and/or ashing residues on the semiconductor substrate, a method for producing a semiconductor device, and a cleaning method using the cleaning composition. The cleaning composition for removing plasma etching residues and/or ashing residues formed on a semiconductor substrate, and a preparation method and a cleaning method for a semiconductor device, using the cleaning composition, wherein the cleaning composition includes (Component a) water; (Component b) an amine compound; (Component c) hydroxylamine and/or a salt thereof; (Component d) a quaternary ammonium compound; (Component e) an organic acid; and (Component f) a water-soluble organic solvent; and has a pH of 6 to 9.

14 Claims, 6 Drawing Sheets

CLEANING COMPOSITION, METHOD FOR PRODUCING SEMICONDUCTOR DEVICE, AND CLEANING METHOD

BACKGROUND OF THE INVENTION

1. Field of the Invention

The present invention relates to a cleaning composition, a method for producing a semiconductor device, and a cleaning method.

2. Description of the Related Art

In the production of semiconductor integrated circuits, progress is being made in terms of increases in scale, increases in density, and miniaturization. In the production of integrated circuits, a lithography step in which a positive type or negative type photoresist is used is employed. A resist film provided on a semiconductor substrate by coating is exposed by an exposure plate such as a photomask or the like. The pattern formed by a photochemical change in the resist film becomes a resist pattern having a shape corresponding to the exposure plate by development. In order to improve the etching resistance of the resist pattern, a post-bake or UV curing is carried out, as needed. The obtained resist pattern is used as a mask to carry out etching or ion injection for the semiconductor substrate.

When the resist pattern is used as a mask to etch a metal layer or an insulating layer on the semiconductor substrate by plasma etching, the photoresist or the residues derived from the metal layer or the insulating layer are formed on the semiconductor substrate. In order to remove the residues formed on the substrate by plasma etching, cleaning using a cleaning composition is carried out.

Furthermore, unnecessary resist patterns are removed thereafter from the semiconductor substrate. Examples of the removing method include a wet type method using a stripper solution and a dry type method involving ashing. Examples of the ashing include plasma ashing. In the method using plasma ashing, an electric field is applied onto oxygen plasma and accelerated in the direction of the electric field to ash the resist pattern. In order to remove the residues generated on the substrate by ashing, a cleaning composition is used.

For example, JP 3219020B discloses a cleaning treatment agent for the surface of a semiconductor substrate provided with a metal wiring, mainly including (a) an organic acid selected from the group consisting of an aminocarboxylic acid selected from oxycarboxylic acids except for monocarboxylic acid, dicarboxylic acid, tricarboxylic acid, and gallic acid, aspartic acid, and glutamic acid, and (b) a complexing agent selected from the group consisting of an aminopolycarboxylic acid selected from ethylenediamine tetraacetic acid and trans-1,2-diaminocyclohexane tetraacetic acid, phosphoric acid derivatives, condensed phosphoric acids, diketones, amines, and inorganic ions selected from halide ions, cyanide ions, thiocyanate ions, thiosulfate ions, and ammonium ions.

In addition, JP3850039B discloses a composition for removing chemically targeted residues from the surface of a metal or a dielectric, in which these chemically targeted residues are applied in the previous step, wherein the composition further suspends the chemically targeted effects from these chemically targeted residues and includes an aqueous solution with a pH of about 3.5 to about 7, and contains (a) a monofunctional, difunctional, or trifunctional organic acid; and (b) a buffering amount of hydroxylamine or a hydroxylamine salt.

SUMMARY OF THE INVENTION

However, it is known that tungsten exposed by misalignment is deformed into a state which is susceptible to corrosion after the ashing step, and with conventional cleaning liquids, tungsten may corrode during cleaning in some cases. Thus, there has been a demand for a cleaning composition which can maintain the cleaning performance and inhibit the corrosion of tungsten. Further, it has been required to inhibit the corrosion of other metals such as aluminum, copper, and the like, in addition to the cleaning performance and the inhibition of the corrosion of tungsten.

Thus, the present invention has been made in consideration of the above-problems, and it is an object of the present invention to provide a cleaning composition, which can inhibit the corrosion of metals such as tungsten, aluminum, and the like of the semiconductor substrate, and has an excellent removability of plasma etching residues and/or ashing residues on the semiconductor substrate, a method for producing a semiconductor device, and a cleaning method using the cleaning composition.

In order to solve the problems of the present invention, the cleaning composition of the present invention is provided for removing plasma etching residues and/or ashing residues formed on a semiconductor substrate, which includes (Component a) water; (Component b) an amine compound; (Component c) hydroxylamine and/or a salt thereof; (Component d) a quaternary ammonium compound; (Component e) an organic acid; and (Component f) a water-soluble organic solvent; and has a pH of 6 to 9.

Furthermore, the component b is preferably an aliphatic amine having 3 to 16 carbon atoms.

Moreover, the component b is preferably at least one compound selected from the group consisting of an alkylamine having 3 to 16 carbon atoms and a dialkylamine having 3 to 16 carbon atoms.

Furthermore, the component b is preferably at least one compound selected from the group consisting of 2-ethylhexylamine, diethylamine, n-butylamine, 3-methoxypropylamine, tert-butylamine, benzylamine, n-hexylamine, cyclohexylamine, n-octylamine, N-methyl-N-butylamine, N-(3-aminopropyl)morpholine, 2-aminoethanol, o-xylenediamine, m-xylenediamine, p-xylenediamine, and n-dodecylamine.

Furthermore, the component c is preferably at least one compound selected from the group consisting of hydroxylamine, hydroxylamine sulfate, hydroxylamine hydrochloride, hydroxylamine nitrate, and hydroxylamine phosphate.

Furthermore, the component d is preferably tetraalkylammonium hydroxide.

Furthermore, the component e is preferably at least one compound selected from the group consisting of lactic acid, citric acid, formic acid, oxalic acid, acetic acid, propionic acid, malonic acid, succinic acid, glutaric acid, maleic acid, fumaric acid, phthalic acid, glycolic acid, gluconic acid, salicylic acid, tartaric acid, and malic acid.

Moreover, the component e is preferably a carboxylic acid having a hydroxyl group.

Furthermore, the component f is preferably at least one compound selected from the group consisting of dipropylene glycol, 2-methyl-2,4-pentanediol, 1,3-butanediol, 1,2-cyclohexanediol, 2-butanol, 2,3-dimethyl-2,3-butanediol, glycerin, propylene glycol monomethyl ether, and diethylene glycol.

Furthermore, the plasma etching residues and/or the ashing residues are preferably residues including at least one metal selected from the group consisting of aluminum, copper, and tungsten.

Furthermore, the cleaning composition is preferably used for removing plasma etching residues and ashing residues.

Furthermore, in order to solve the above-described problems of the present invention, the method for producing a semiconductor device of the present invention preferably includes an etching step of carrying out plasma etching for a semiconductor substrate; and/or an ashing step of carrying out ashing for the semiconductor substrate, and a cleaning step of cleaning the plasma etching residues and/or the ashing residues formed on the semiconductor substrate in the etching step and/or the ashing step, by means of the cleaning composition including (Component a) water; (Component b) an amine compound; (Component c) hydroxylamine and/or a salt thereof; (Component d) a quaternary ammonium compound; (Component e) an organic acid; and (Component f) a water-soluble organic solvent; and having a pH of 6 to 9. In this regard, the semiconductor substrate is preferably aluminum, copper, and/or tungsten.

Furthermore, in order to solve the above-described problems of the present invention, the cleaning method of the present invention includes a cleaning step of cleaning the semiconductor base after the plasma etching and/or ashing step by means of the cleaning composition, which includes (Component a) water; (Component b) an amine compound; (Component c) hydroxylamine and/or a salt thereof; (Component d) a quaternary ammonium compound; (Component e) an organic acid; and (Component f) a water-soluble organic solvent; and has a pH of 6 to 9. Herein, the semiconductor substrate preferably includes aluminum, copper, and/or tungsten.

Due to the present invention, the corrosion of a metal of the semiconductor substrate can be inhibited, and a cleaning composition having an excellent removability of plasma etching residues and/or ashing residues on the semiconductor substrate, a method for producing a semiconductor device, and a cleaning method using the cleaning composition can be provided.

DESCRIPTION OF THE PREFERRED EMBODIMENTS

Figure 1:
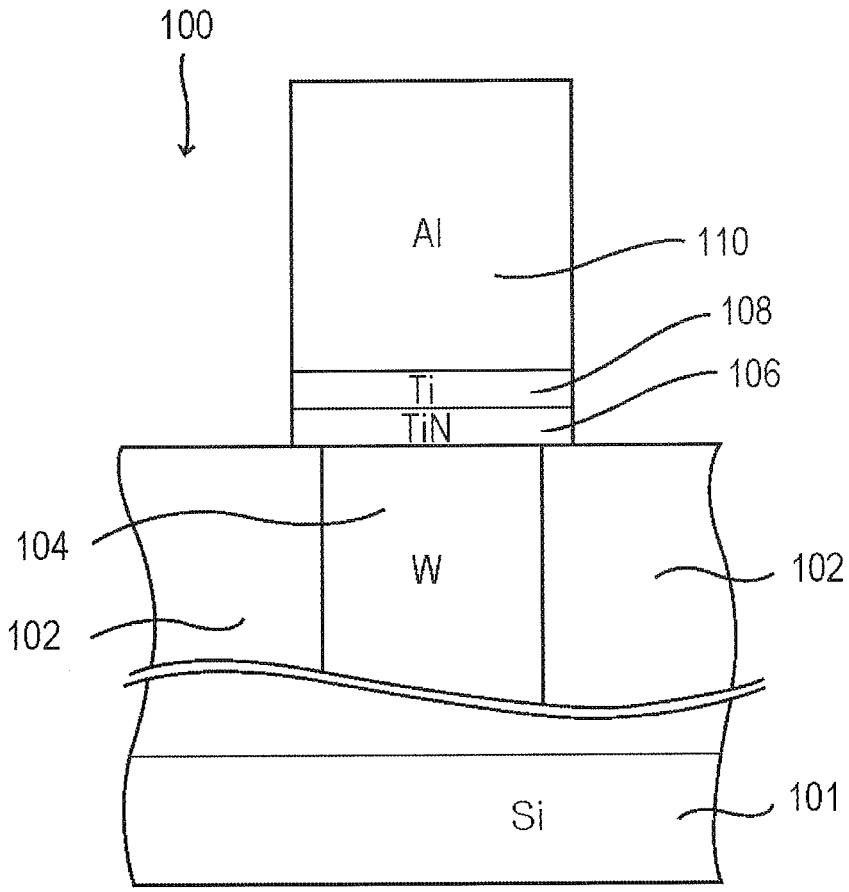
FIG. 1 is a schematic cross-sectional view showing the wiring pattern at an ordinary time in one embodiment of the method for producing a semiconductor device of the present invention.

Hereinafter, the present invention will be described in detail.

(Cleaning Composition)

The cleaning composition of the present invention for removing plasma etching residues and/or ashing residues formed on a semiconductor substrate (simply as referred to as a "cleaning composition") includes (Component a) water; (Component b) an amine compound; (Component c) hydroxylamine and/or a salt thereof; (Component d) a quaternary ammonium compound; (Component e) an organic acid; and (Component f) a water-soluble organic solvent; and has a pH of 6 to 9.

Furthermore, the cleaning composition of the present invention is preferably a cleaning composition for removing plasma etching residues and/or ashing residues, which includes aluminum, copper, and/or tungsten, as described later.

The pH of the cleaning composition of the present invention is 6 to 9, preferably 7.0 to 9.0, more preferably 7.0 to 8.5, even more preferably 7.2 to 8.4, and particularly preferably 7.2 to 8.0. If the pH is within the above-described range, the semiconductor substrate having an excellent inhibitory property against corrosion of tungsten of the semiconductor substrate, and the photoresist, the antireflective film, or the plasma etching residues and ashing residues can be removed sufficiently.

As for a method for measuring the pH, the pH can be measured using a commercially available pH-meter.

Adjustment to a predetermined pH of the cleaning composition is not particularly limited, but is preferably carried out by controlling the addition amount of (Component a) water; (Component b) an amine compound; (Component c) hydroxylamine and/or a salt thereof; (Component d) a quaternary ammonium compound; and/or (Component e) an organic acid; or particularly by controlling the addition amount of (Component c) hydroxylamine and/or a salt thereof.

<(Component a) Water>

The cleaning composition of the present invention contains water as a solvent.

The content of water in the cleaning composition of the present invention is preferably 50% by weight or more, more preferably 50 to 99.5% by weight, even more preferably 60 to 99% by weight, and particularly preferably 70 to 95% by weight, based on the total weight of the cleaning composition.

As water, ultra-pure water used for the production of a semiconductor is preferred.

<(Component b) Amine Compound>

The cleaning composition of the present invention contains an amine compound. Further, the (Component b) amine compound in the present invention is an amine compound other than hydroxylamine and a salt thereof.

The amine compound which can be used in the present invention may be an aliphatic amine compound or an aromatic amine compound, but an aliphatic amine compound is preferred. Further, the aromatic amine compound refers to an amine compound in which an aromatic group is directly bonded to at least one nitrogen atom, and an amine compound other than the aromatic amine compound is referred to as an aliphatic amine compound.

Furthermore, the amine compound which can be used in the present invention may be, for example, a compound having a high molecular weight such as a polyethyleneimine and the like.

In addition, the amine compound which can be used in the present invention is more preferably an aliphatic amine other than an alkanolamine, and even more preferably an aliphatic amine having no oxygen atom.

The amine compound which can be used in the present invention preferably has 3 to 16 carbon atoms, more preferably 4 to 12 carbon atoms, and even more preferably 5 to 10 carbon atoms. Within the above-described range, the inhibitory property against corrosion of tungsten of the semiconductor substrate is excellent.

Examples of the amine compound which can be used in the present invention preferably include a monoalkylamine compound and a dialkylamine compound, more preferably a monoalkylamine compound having 3 to 16 carbon atoms and a dialkylamine compound having 3 to 16 carbon atoms, and even more preferably a monoalkylamine compound having 3 to 16 carbon atoms. According to this embodiment, the inhibitory property against corrosion of tungsten of the semiconductor substrate is excellent.

The alkyl group which is directly bonded to a nitrogen atom in the amine compound may be linear or branched or may have a ring structure, but is preferably linear or branched, and more preferably branched. Further, the alkyl group may have a substituent. The substituent is not particularly limited as long as it does not interfere with the effect of the present invention severely, but examples thereof include a hydroxy group, an alkoxy group, and an aryl group.

Moreover, the amine compound which can be used in the present invention is preferably a compound represented by the following formula (B).

[Chem. 1]

(B)

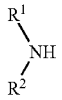

(in the formula (B), $R^1$ represents an alkyl group and $R^2$ represents a hydrogen atom or an alkyl group).

The alkyl group in $R^1$ and $R^2$ may be linear or branched, may have a ring structure, and may have a substituent.

Examples of the substituent preferably include a hydroxyl group, an alkoxy group, and an aryl group, and the alkyl group in $R^1$ and $R^2$ preferably has no oxygen atom, and more preferably has no substituent.

Furthermore, the alkyl group in $R^1$ and $R^2$ preferably has 1 to 16 carbon atoms, more preferably 2 to 12 carbon atoms, and even more preferably 5 to 10 carbon atoms.

Moreover, the alkyl group in $R^1$ and $R^2$ is preferably linear or branched, and more preferably branched.

Examples of the alkyl group in $R^1$ and $R^2$ include a methyl group, an ethyl group, a n-propyl group, an isopropyl group, an n-butyl group, a tert-butyl group, an isobutyl group, a sec-butyl group, an n-pentyl group, a 2-pentyl group, a cyclopentyl group, an n-hexyl group, a cyclohexyl group, an n-heptyl group, an n-octyl group, a 2-ethylhexyl group, an n-decyl group, an n-dodecyl group, and a benzyl group.

In addition, $R^2$ in the formula (B) is preferably a hydrogen atom.

Examples of the amine compound which can be used in the present invention preferably include 2-ethylhexylamine, diethylamine, n-butylamine, 3-methoxypropylamine, tert-butylamine, benzylamine, n-hexylamine, cyclohexylamine, n-octylamine, N-methyl-N-butylamine, o-xylenediamine, m-xylenediamine, p-xylenediamine, N-(3-aminopropyl) morpholine, 2-aminoethanol, polyethyleneimine, and n-dodecylamine, more preferably 2-ethylhexylamine, diethylamine, n-butylamine, 3-methoxypropylamine, tert-butylamine, benzylamine, n-hexylamine, cyclohexylamine, n-octylamine, N-methyl-N-butylamine, N-methyl-N-butylamine, o-xylenediamine, m-xylenediamine, p-xylenediamine, and n-dodecylamine, and even more preferably 2-ethylhexylamine, n-butylamine, 3-methoxypropylamine, tert-butylamine, benzylamine, n-hexylamine, n-octylamine, N-methyl-N-butylamine, N-methyl-N-butylamine, o-xylenediamine, m-xylenediamine, p-xylenediamine, and n-dodecylamine.

The cleaning composition of the present invention may contain one or two or more kinds of the amine compound.

The content of the amine compound in the cleaning composition of the present invention is preferably 0.01 to 20% by weight, and more preferably 0.1 to 10% by weight, based on the total weight of the cleaning composition.

<(Component c) Hydroxylamine and/or Salt Thereof>

The cleaning composition of the present invention contains hydroxylamine and/or a salt thereof. By incorporating hydroxylamine and/or a salt thereof, the plasma etching residues and/or the ashing residues can be cleaned easily.

The salt of the hydroxylamine which can be used in the present invention is preferably an inorganic acid salt or an organic acid salt of the hydroxylamine, and particularly preferably a salt of hydrochloric acid, sulfuric acid, nitric acid, phosphoric acid, phosphonic acid, or any other acid, and a mixture of two or more kinds thereof.

The salt of the hydroxylamine which can be used in the present invention is preferably hydroxylamine nitrate (also referred to as HAN), hydroxylamine sulfate (also referred to as HAS), hydroxylamine phosphate, or hydroxylamine hydrochloride, or may be a mixture of two or more kinds thereof.

In addition, as the salt of the hydroxylamine, an organic acid salt of the hydroxylamine may also be used, and specific examples thereof include hydroxylamine citrate and hydroxylamine oxalate. Further, examples of the salt of the hydroxylamine also include N,N-diethylhydroxylamine sulfate, N,N-diethylhydroxylamine nitrate, and the like.

The cleaning composition of the present invention may contain one or two or more kinds of the hydroxylamine and a salt thereof.

The content of the hydroxylamine and/or a salt thereof in the cleaning composition of the present invention is preferably 0.01 to 30% by weight, more preferably 0.1 to 15% by weight, and even more preferably 1 to 10% by weight, based on the total weight of the cleaning composition.

<(Component d) Quaternary Ammonium Compound>

The cleaning composition of the present invention contains a quaternary ammonium compound. The quaternary ammonium compound is added to adjust the pH of the cleaning composition, but also exerts a beneficial effect since it enables the plasma etching residues and/or the ashing residues to be more easily cleaned. Further, the quaternary ammonium compound exerts a beneficial effect in terms of inhibition of the metal corrosion.

Examples of the quaternary ammonium compound which can be used in the present invention include quaternary ammonium hydroxide, quaternary ammonium fluoride, quaternary ammonium bromide, quaternary ammonium iodide, acetate of quaternary ammonium, carbonate of quaternary ammonium, and the like, and among these, quaternary ammonium hydroxide is preferred.

As the quaternary ammonium hydroxide, tetraalkylammonium hydroxide is preferred, and tetraalkylamtnonium hydroxide substituted with a lower alkyl group (alkyl group having 1 to 4 carbon atoms) or an aromatic alkyl group is further preferred. Specific examples thereof include tetraalkylammonium hydroxide having 4 alkyl groups such as methyl, ethyl, propyl, butyl, hydroxyethyl, and benzyl. Example of the tetraalkylammonium hydroxide include tetramethylammonium hydroxide (hereinafter referred to as TMAH), tetraethylammonium hydroxide, tetrabutylammonium hydroxide (TBAH), trimethylhydroxyethylammonium hydroxide, methyl tri(hydroxyethyl)ammonium hydroxide, tetra(hydroxyethyl)ammonium hydroxide, benzyltrimethylammonium hydroxide (hereinafter referred to as BTMAH), and the like. In addition, a combination of ammonium hydroxide and one or more quaternary ammonium hydroxides may also be used.

Furthermore, the quaternary ammonium salt-based surfactant as described later may also be exemplified.

Among these, TMAH, tetraethylammonium hydroxide, TBAH, trimethylhydroxyethylammonium hydroxide, methyl tri(hydroxyethyl)ammonium hydroxide, tetra(hydroxyethyl) ammonium hydroxide, and BTMAH are preferred, TMAH, TBAH, and BTMAH are more preferred, and TMAH is even more preferred.

The cleaning composition of the present invention may contain one or two or more kinds of the quaternary ammonium compound.

The content of the quaternary ammonium compound in the cleaning composition of the present invention is preferably 0.01 to 20% by weight, more preferably 1.0 to 15% by weight, and even more preferably 3.0 to 10% by weight, based on the total weight of the cleaning composition.

<(Component e) Organic Acid>

The cleaning composition of the present invention contains an organic acid. By incorporating the organic acid in the cleaning composition of the present invention, the inhibitory property against corrosion of tungsten of the semiconductor substrate is excellent, and the removability of the plasma etching residues and/or the ashing residues on the semiconductor substrate is excellent.

The organic acid which can be used in the present invention is preferably a carboxylic acid, and a carboxylic acid having a hydroxyl group is more preferably contained. By incorporating a carboxylic acid, particularly a carboxylic acid having a hydroxyl group, corrosion of metals such as aluminum, copper, tungsten, and an alloy thereof can be effectively prevented.

Preferred examples of the carboxylic acid include a monocarboxylic acid and a polycarboxylic acid.

The organic acid is not limited to these, but examples thereof include citric acid, lactic acid, formic acid, glycolic acid, oxalic acid, acetic acid, propionic acid, valeric acid, isovaleric acid, succinic acid, malic acid, glutaric acid, maleic acid, fumaric acid phthalic acid, 1,2,3-benzenetricarboxylic acid, salicylic acid, tartaric acid, gluconic acid, malonic acid, diglycolic acid, acetohydroxamic acid, benzohydroxamic acid, salicylhydroxamic acid, phthalhydroxamic acid, benzoic acid, and dihydroxybenzoic acid, and a mixture of two or more kinds thereof.

Among these, lactic acid, citric acid, formic acid, oxalic acid, acetic acid, propionic acid, malonic acid, succinic acid, glutaric acid, maleic acid, fumaric acid, phthalic acid, glycolic acid, gluconic acid, salicylic acid, tartaric acid, and malic acid, and a mixture of two or more kinds thereof are preferred, and citric acid, glycolic acid, gluconic acid, tartaric, and malic acid are further preferred.

Furthermore, the organic acid preferably has no amino group, and more preferably has only C, H, and O as the constituents.

The cleaning composition of the present invention may contain one or two or more kinds of the organic acid.

The content of the organic acid in the cleaning composition of the present invention is preferably 0.01 to 30.0% by weight, more preferably 0.05 to 20.0% by weight, and even more preferably 0.1 to 10.0% by weight, based on the total weight of the cleaning composition.

<(Component f) Water-Soluble Organic Solvent>

The cleaning composition of the present invention contains a water-soluble organic solvent. By incorporating the water-soluble organic solvent in the cleaning composition of the present invention, the inhibitory property against corrosion of tungsten of the semiconductor substrate is excellent, and particularly, the removability of the plasma etching residues and/or the ashing residues on the semiconductor substrate is excellent.

Furthermore, the water-soluble organic solvent in the present invention is a compound other than the compounds corresponding to the component b to the component e.

In addition, the "water-solubility" in the present invention indicates that the solubility in water at 25° C. is 0.1 g/L or more.

Examples of the water-soluble organic solvent which can be used in the present invention include alcohol-based solvents such as 2-methyl-2,4-pentanediol, 1,3-butanediol, 2-butanol, 1,2-cyclohexanediol, pinacol, dipropylene glycol (1,1'-oxydi(2-propanol)), glycerin, and the like, ether-based solvents such as ethylene glycol monomethyl ether, diethylene glycol, diethylene glycol monomethyl ether, triethylene glycol, polyethylene glycol, propylene glycol monomethyl ether, dipropylene glycol monomethyl ether, tripropylene glycol monomethyl ether, diethylene glycol monobutyl ether, diethylene glycol monobutyl ether, and the like, amide-based solvents such as formamide, monomethylformamide, dimethylformamide, acetamide, monomethylacetamide, dimethylacetamide, monoethylacetamide, diethylacetamide, N-methylpyrrolidone, and the like, sulfur-containing-based solvents such as dimethylsulfone, dimethylsulfoxide, sulfolane, and the like, lactone-based solvents such as γ-butyrolactone, δ-valerolactone, and the like, and the like.

Among these, preferred examples thereof include the alcohol-based solvents and the ether-based solvents, and further preferred examples include the alcohol-based solvents.

The alcohol-based solvent is preferably a compound having a secondary hydroxyl group and/or a tertiary hydroxyl group, and more preferably a compound at least a secondary hydroxyl group.

In addition, the alcohol-based solvent may be a monoalcohol compound or a polyalcohol compound, but is preferably a diol compound.

The water-soluble organic solvent which can be used in the present invention is preferably at least one compound selected from the group consisting of 2-methyl-2,4-pentanediol, 1,3-butanediol, 1,2-cyclohexanediol, 2-butanol, 2,3-dimethyl-2,3-butanediol, dipropylene glycol, glycerin, propylene glycol monomethyl ether, and diethylene glycol, and more preferably at least one compound selected from the group consisting of dipropylene glycol, 2-methyl-2,4-pentanediol, 1,3-butanediol, and glycerin.

The cleaning composition of the present invention may contain one or two or more kinds of the water-soluble organic solvent.

The content of the water-soluble organic solvent in the cleaning composition of the present invention is preferably 0.1 to 45% by weight, more preferably 0.5 to 40% by weight, and even more preferably 1 to 25% by weight, based on the total weight of the cleaning composition. Within the above-described range, the inhibitory property against corrosion of tungsten of the semiconductor substrate and the removability of the plasma etching residues and/or the ashing residues on the semiconductor substrate are more excellent.

The cleaning composition of the present invention may contain (Component g) an inorganic acid and/or a salt thereof, (Component h) a surfactant, and/or known additives as listed below, in addition to the (Component a) to (Component f) as above, as optional components.

<(Component g) Inorganic Acid and/or Salt Thereof>

The cleaning composition of the present invention may contain an inorganic acid and/or a salt thereof. By incorporating an inorganic acid and/or a salt thereof in the cleaning composition of the present invention, the surface of aluminum in a cleaning target, such as a semiconductor substrate and the like, is smoothened and the cleanability can also be improved. Further, the corrosion of aluminum can be prevented or inhibited. In addition, by incorporating an inorganic acid and/or a salt thereof in the cleaning composition, the temperature range of the cleaning composition capable of realizing sufficient cleaning while preventing or inhibiting the corrosion, and the range of immersion time of the cleaning target for the cleaning composition can be further extended, as compared with a case of not incorporating the inorganic acid and/or a salt thereof.

Examples of the inorganic acid which can be used in the present invention include phosphoric acid, boric acid, hexafluorophosphoric acid and a mixture of two or more kinds thereof.

In addition, salts of the inorganic acids can also be used in the cleaning composition of the present invention, and examples thereof include ammonium salts and the like of the inorganic acids. Specific examples thereof include ammonium phosphate, ammonium borate, ammonium hexafluorophosphate, and the like.

Among these, phosphoric acid and phosphate are preferred and phosphoric acid is more preferred.

The cleaning composition of the present invention may not contain an inorganic acid and/or a salt thereof, or may contain one or two or more kinds of the inorganic acid and/or a salt thereof.

When the cleaning composition of the present invention contains an inorganic acid and/or a salt thereof, the content of the organic acid in the cleaning composition of the present invention is preferably from 0.1% by weight to less than 0.5% by weight, more preferably 0.1 to 0.4% by weight, and even more preferably 0.15 to 0.3% by weight, based on the total weight of the cleaning composition.

<(Component h) Surfactant>

The cleaning composition of the present invention may contain a surfactant.

As the surfactant, a nonionic surfactant, anion surfactant, a cationic surfactant, and an amphoteric surfactant can be used.

As the surfactant used in the present invention, a nonionic surfactant is preferably used from the standpoint that it can adjust the viscosity of the cleaning composition and improve the wettability toward the cleaning target due to its addition, and from the standpoint that both of the removability of the residues and the corrosion resistance for a substrate, an insulating film, or the like are more excellent.

As the nonionic surfactant, for example, a polyalkylene oxide alkylphenyl ether-based surfactant, a polyalkylene oxide alkyl ether-based surfactant, a block polymer-based surfactant including polyethylene oxide and polypropylene oxide, a polyoxyalkylene distyrenated phenyl ether-based surfactant, a polyalkylene tribenzylphenyl ether-based surfactant, an acetylene polyalkylene oxide-based surfactant, or the like can be used.

Among these, a polyalkylene oxide (hereinafter referred to as PAO) alkyl ether-based surfactant is preferred, and a polyalkylene oxide alkyl ether-based surfactant selected from a PAO decyl ether, a PAO lauryl ether, a PAO tridecyl ether, a PAO alkylenedecyl ether, a PAO sorbitan monolaurate, a PAO sorbitan monooleate, a PAO sorbitan monostearate, a tetraoleic acid polyethylene oxide sorbitol, a PAO alkylamine, and a PAO acetylene glycol is further preferred. As the polyalkylene oxide, a polymerization product of polyethylene oxide, polypropylene oxide, or polybutylene oxide is preferred.

Furthermore, as the surfactant used in the present invention, a cationic surfactant is also preferably used from the standpoint that both the removability of the residues and the corrosion for a substrate, an insulating film, or the like are more excellent. Examples of the cationic surfactant include an alkylpyridium-based surfactant, or a quaternary ammonium salt-based surfactant corresponding to the above-mentioned component d.

As the quaternary ammonium salt-based surfactant, a compound represented by the following formula (1) is preferred.

[Chem. 2]

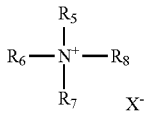

(1)

(in the formula (1), $X^-$ represents a hydroxide ion, a chloride ion, a bromide ion, or a nitrate ion, $R_5$ represents an alkyl group having 8 to 18 carbon atoms, $R_6$ and $R_7$ each independently represent an alkyl group having 1 to 18 carbon atoms, an aryl group having 6 to 18 carbon atoms, a hydroxyalkyl group having 1 to 8 carbon atoms, or a benzyl group, and $R_8$ represents an alkyl group having 1 to 3 carbon atoms).

In the formula (1), $X^-$ represents a counter anion, and specifically a hydroxide ion, a chloride ion, a bromide ion, or a nitrate ion.

In the formula (1), $R_5$ is an alkyl group having 8 to 18 carbon atoms (preferably an alkyl group having 12 to 18 carbon atoms, and examples thereof including a cetyl group, a stearyl group, and the like).

In the formula (1), $R_6$ and $R_7$ each independently represent an alkyl group having 1 to 18 carbon atoms, an aryl group having 6 to 18 carbon atoms (for example, a phenyl group and the like), a hydroxyalkyl group having 1 to 8 carbon atoms (for example, hydroxyethyl and the like), or a benzyl group.

In the formula (1), $R_8$ represents an alkyl group having 1 to 3 carbon atoms (for example, a methyl group, an ethyl group, and the like).

Specific examples of the compound represented by the formula (1) include cetyltrimethylammonium chloride, didodecyldimethylammonium chloride, tridecylmethylammonium chloride, stearylbenzyldimethylammonium chloride, and the like. The counter anion of these compounds is not limited to a chloride ion, and it may be a bromide ion or a hydroxide ion.

Furthermore, specific examples of the alkylpyridinium-based surfactant include cetylpyridinium chloride and the like. The counter anion of these compounds is not limited to a chloride ion, and it may be a bromide ion or a hydroxide ion.

The cleaning composition of the present invention may not contain a surfactant or may contain one or two or more kinds of the surfactant.

When the cleaning composition of the present invention contains the surfactant, the content of the surfactant in the cleaning composition of the present invention is preferably 0.0001 to 5% by weight, and more preferably 0.0001 to 1% by weight, based on the total weight of the cleaning composition. It is preferable to add a surfactant to the cleaning composition since the viscosity of the cleaning composition can be adjusted and the wettability toward the cleaning target can be improved, and in addition, from the standpoint that the corrosion of a substrate, an insulating film, and the like is further excellent. These surfactants are generally available commercially.

(Cleaning Method)

Next, the cleaning method of the present invention will be described.

The cleaning method of the present invention includes a preparation step of preparing a cleaning composition of the present invention and a cleaning step of cleaning the plasma etching residues and/or the ashing residues formed on a semiconductor substrate by means of the cleaning composition.

The preparation step is a step of preparing the cleaning composition of the present invention. The cleaning composition of the present invention is prepared by mixing the component a to the component d which are essential components as described above, and if necessary, the component e to the component h which are optional components.

The pH of the cleaning composition of the present invention is 6 to 9, preferably 7.0 to 9.0, more preferably 7.0 to 8.5, even more preferably 7.2 to 8.4, and particularly preferably 7.2 to 8.0.

Adjustment of the pH is not particularly limited, but is preferably carried out by controlling the addition amount of (Component a) water; (Component b) an amine compound; (Component c) hydroxylamine and/or a salt thereof; (Component d) a quaternary ammonium compound; and/or (Component e) an organic acid, or particularly by controlling the addition amount of (Component c) hydroxylamine and/or a salt thereof.

The cleaning step is a step of cleaning the plasma etching residues and/or the ashing residues formed on a semiconductor substrate by means of the cleaning composition of the present invention.

The plasma etching residues and/or ashing residues to be cleaned and removed in the cleaning step are preferably formed on a semiconductor substrate by an etching step of carrying out plasma etching of the semiconductor substrate and/or an ashing step of carrying out ashing of the semiconductor substrate.

In the etching step, a resist pattern is used as a mask for plasma etching in some cases. In this case, it is preferable to carry out an ashing step of removing the resist pattern by ashing employing, for example, plasma, ozone, and the like after the etching step but prior to the cleaning step. The ashing residue to be cleaned and removed in the cleaning step is preferably formed on the semiconductor substrate by ashing in the ashing step.

The semiconductor substrate preferably has a metal layer such as a via, a wiring, and the like formed thereon, more preferably includes at least one metal selected from the group consisting of aluminum, copper, and tungsten, and particularly includes aluminum, copper, and/or tungsten.

An embodiment of cleaning in the cleaning step is not particularly limited as long as the surface of the semiconductor substrate on which at least plasma etching residues and/or ashing residues are formed is contacted with the cleaning composition of the present invention, but an embodiment in which the semiconductor substrate is immersed in the cleaning composition of the present invention is preferred.

(Method for Producing Semiconductor Device)

Next, the method for producing a semiconductor device of the present invention will be described in detail.

The method for producing a semiconductor device of the present invention includes an etching step of carrying out plasma etching for a semiconductor substrate and/or an ashing step of carrying out ashing for a resist on the semiconductor substrate, and a cleaning step of cleaning the plasma etching residues and/or the ashing residues formed on the semiconductor substrate in the etching step and/or the ashing step, by means of the cleaning composition of the present invention. Specifically, the method for producing a semiconductor device of the present invention preferably involves applying the cleaning composition of the present invention in cleaning the semiconductor substrate after forming a via hole or a wiring.

Furthermore, the "semiconductor substrate" in the present invention refers to a substrate used in a semiconductor device, and unless specifically described, it may be a semiconductor substrate in the narrow sense, such as a silicon wafer and the like, or may be, for example, a substrate having an interlayer insulating film, a tungsten plug, a via hole, a wiring, or the like formed on a silicon wafer.

Several embodiments are exemplified below.

First Embodiment

The outline of a method for producing a semiconductor device according to the first embodiment of the present invention is described with reference to FIGS. 1 to 3.

Figure 2:
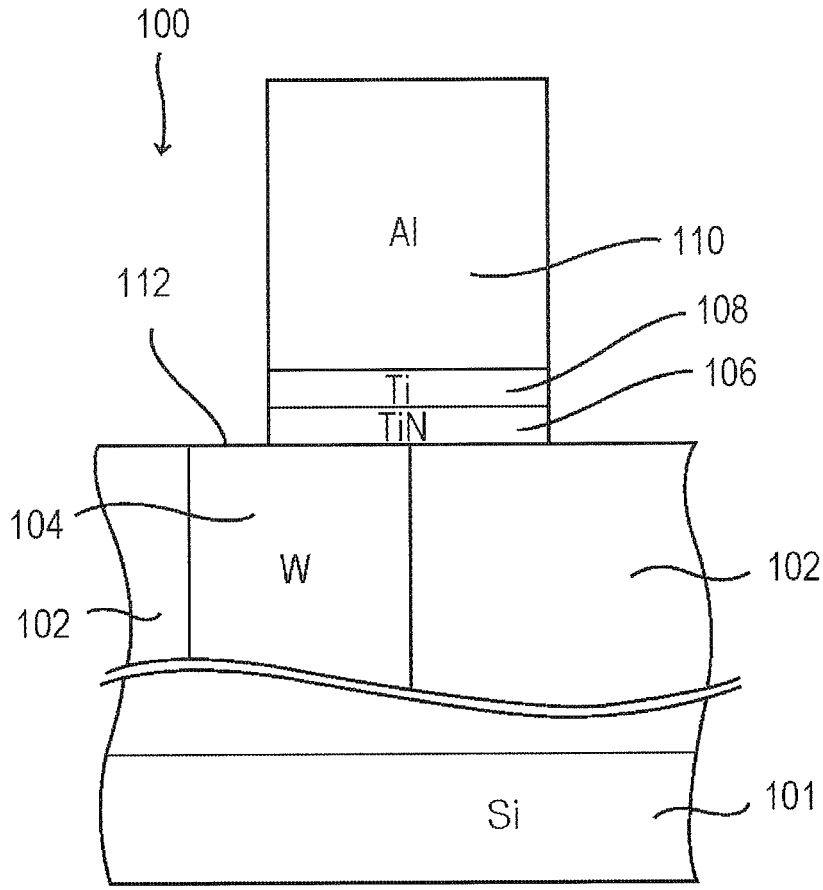
FIG. 2 is a schematic cross-sectional view showing the wiring pattern at misalignment in one embodiment of the method for producing a semiconductor device of the present invention.

FIG. 1 is a schematic cross-sectional view showing the wiring pattern at an ordinary time in one embodiment of the method for producing a semiconductor device of the present invention, and FIG. 2 is a schematic cross-sectional view showing the wiring pattern at misalignment in one embodiment of the method for producing a semiconductor device of the present invention.

Figure 3:
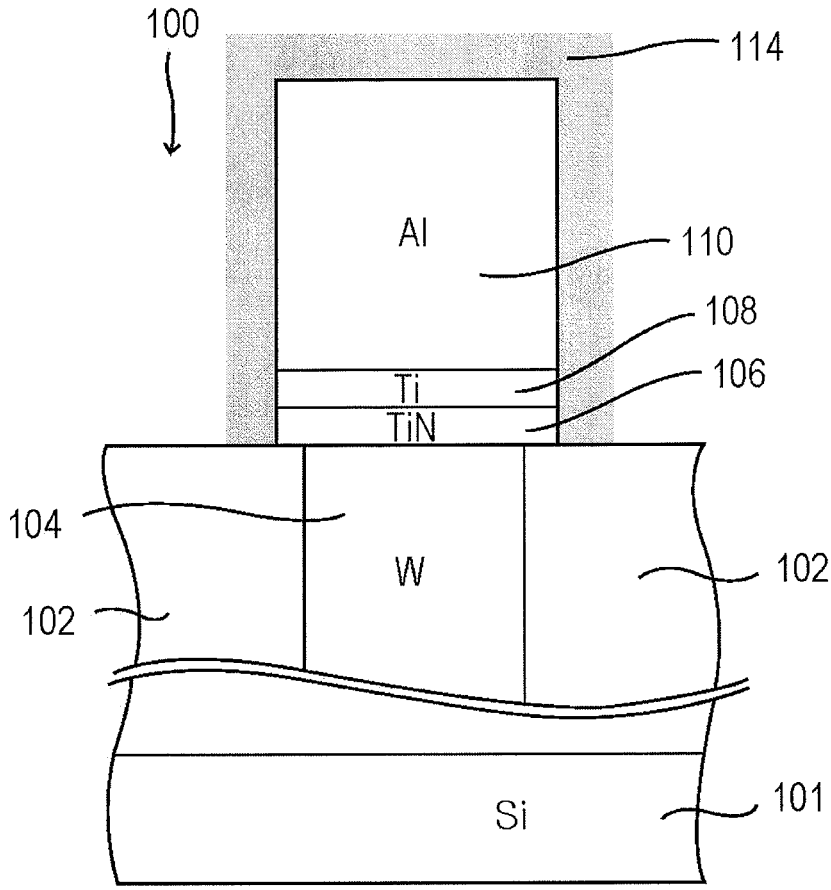
FIG. 3 is a schematic cross-sectional view of the semiconductor device showing a state in which the plasma etching residues and/or the ashing residues are adhered after ashing.

Furthermore, FIG. 3 is a schematic cross-sectional view of the semiconductor device showing a state in which the plasma etching residues and/or the ashing residues are adhered after ashing.

FIG. 1 shows a substrate 100, in which a wiring pattern (a structure formed of an Al alloy film 110, a titanium film 108, and a titanium nitride film 106) is provided on a tungsten plug 104 formed between the interlayer insulating films 102 on a semiconductor substrate 101.

In the method for producing a semiconductor device according to first embodiment of the present invention, first, an element other than a transistor or one layer or two or more layers of a wiring is formed on the semiconductor substrate 101 such as a silicon wafer and the like by an ordinary process for producing a semiconductor device (in which the area is adjacent to the semiconductor substrate 101 in FIG. 1 and the details are not particularly shown). Subsequently, the interlayer insulating film 102 ($SiO_2$ film) is formed on the semiconductor substrate 101 on which an element or the like has been formed. The material for the interlayer insulating film 102 is not particularly limited, but a known material can be used.

A photoresist film (not shown) is formed on the interlayer insulating film 102, and then a photoresist film (not shown) having an opening is formed by photolithography. Subsequently, by dry etching using a plasma with this photoresist film as a mask, the interlayer insulating film 102 is etched and an opening (not shown) is formed on the interlayer insulating film 102. The photoresist film is removed by a wet treatment using a chemical liquid or by ashing using a plasma.

Then, the titanium nitride film 106, for example, having a film thickness of about 50 nm, the titanium film 108, for example, having a film thickness of about 20 nm, the Al alloy film 110, for example, having a film thickness of about 500 nm are sequentially laminated on the front face, for example, by a CVD method. Further, the Al alloy film 110 is an alloy film of Al and Cu, for example, containing 0.1 to 5% of Cu.

Then, a photoresist film (not shown) having the wiring pattern is formed on the Al alloy film 110 by photolithography. Subsequently, the Al alloy film 110, the titanium film 108, and the titanium nitride film 106 are sequentially etched by plasma etching using this photoresist film as a mask. Thus, a wiring including the Al alloy film 110, the titanium film 108, and the titanium nitride film 106 (wiring pattern, a structure formed with the Al alloy film 110, the titanium film 108, and the titanium nitride film 106 in FIG. 1 or FIG. 2) is formed by patterning these conductor films.

Then, most of the photoresist film used as a mask is peeled and removed by a wet treatment using a chemical liquid. Subsequently, by ashing using a plasma (plasma ashing), the remaining portion of the photoresist film is removed (see FIG. 1).

In the etching and the ashing for removing the remaining portion of the photoresist film so as to form a wiring, as shown in FIG. 3, the plasma etching residues and/or the ashing residues 114 are adhered on the substrate surface including the upper face and the side face of the wiring. Further, in not only the structure on the substrate 100 corresponding to FIG. 1 as shown in FIG. 3, but also the structure on the substrate 100 corresponding to FIG. 2, the plasma etching residues and/or the ashing residues 114 are adhered similarly. These plasma etching residues and/or ashing residues 114 are derived from the deformed photoresist film, the Al alloy film 110, the titanium film 108, and the titanium nitride film 106.

Therefore, after the ashing for removing the remaining portion of the photoresist film, the substrate 100 on which a wiring is formed at last is cleaned by the cleaning composition of the present invention. Thus, the plasma etching residues and/or the ashing residues 114 adhered onto the surface of the substrate 100 on which a wiring is formed at last are removed.

By this, the substrate 100 having the wiring pattern on the tungsten plug 104 (a structure formed of the Al alloy film 110, the titanium film 108, and the titanium nitride film 106) as shown in FIG. 1 can be obtained. Further, there occurs a mismatch of the locations of the tungsten plug 104 and the wiring pattern, that is, a misalignment, on a part of the substrate 100 in some cases, as shown in FIG. 2.

In the removal of the plasma etching residues and/or the ashing residues 114 adhered on the surface of the substrate 100, the surface of the tungsten plug 104 is exposed around the wiring in which the misalignment occurs (exposed portion 112), and it is important that the tungsten plug 104 does not corrode during cleaning.

By using the cleaning composition of the present invention, the removability of the plasma etching residues and/or the ashing residues on the semiconductor substrate is not only excellent but the corrosion of tungsten of the semiconductor substrate can also be inhibited.

Second Embodiment

Figure 4A:
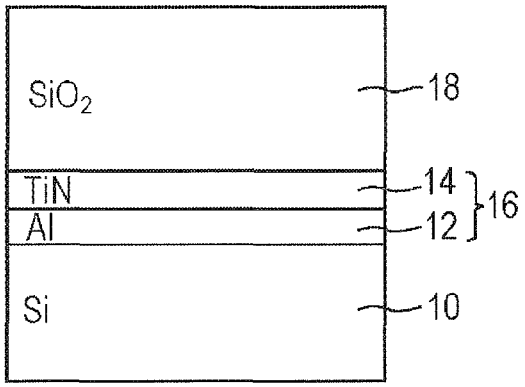
FIG. 4 is a step cross-sectional view showing the outline in another embodiment of the method for producing a semiconductor device of the present invention.
Figure 4B:
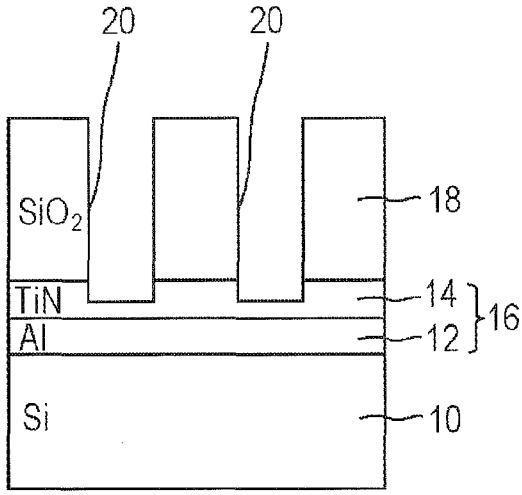
Figure 4C:
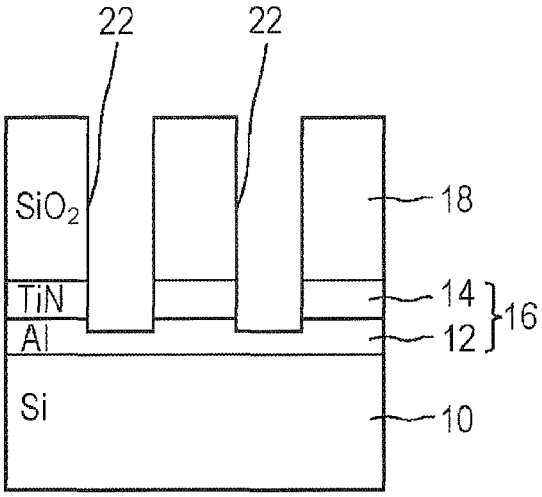
Figure 5A:
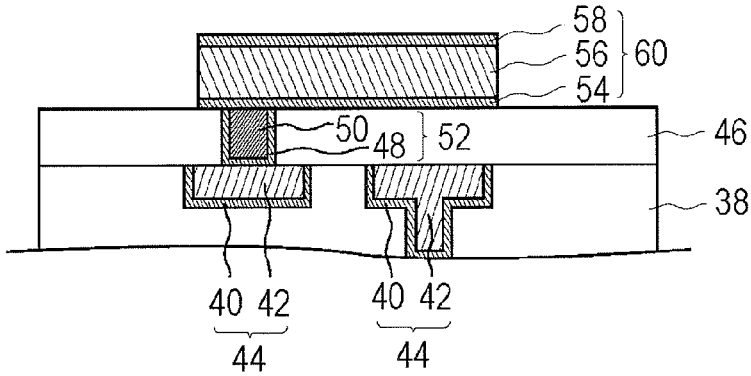
FIG. 5 is a step cross-sectional view showing the outline in still another embodiment of the method for producing a semiconductor device of the present invention.
Figure 5B:
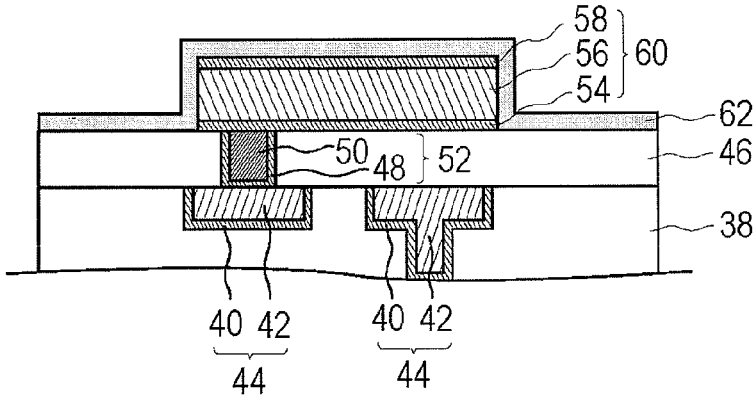
Figure 5C:
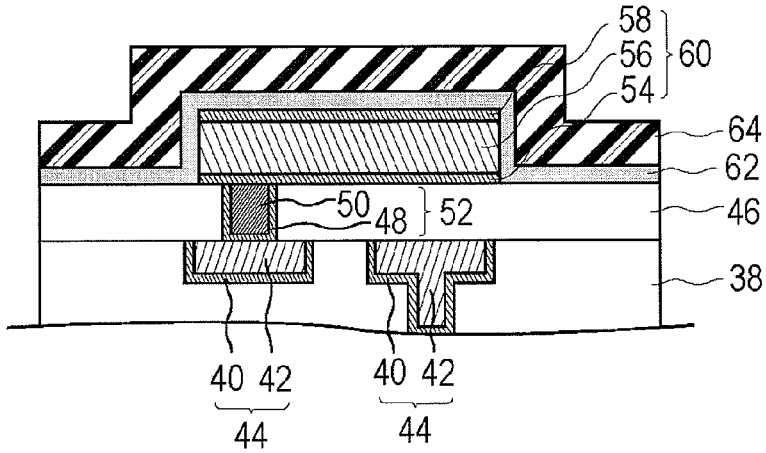
Figure 5D:
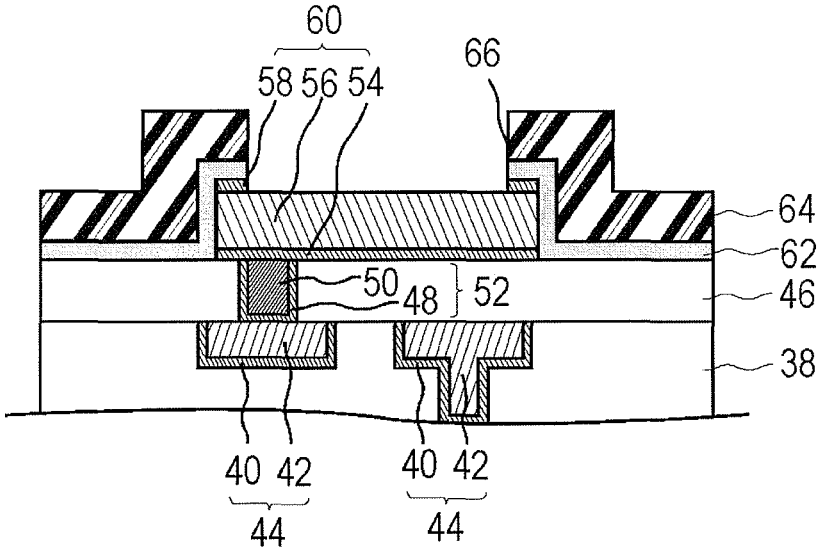

FIG. 4 is a step cross-sectional view showing the outline in another embodiment (the second and third embodiments) of the method for producing a semiconductor device of the present invention.

First, an element other than a transistor or one layer or two or more layers of a wiring is formed on the semiconductor substrate 10 such as a silicon wafer and the like by an ordinary process for producing a semiconductor device. Then, an interlayer insulating film is formed on the semiconductor substrate 10 on which an element or the like has been formed.

Then, an Al alloy film 12 for example, having a film thickness of about 500 nm and a titanium nitride film 14, for example, having a film thickness of about 50 nm are sequentially laminated on the front face, for example, by a CVD (Chemical Vapor Deposition) method. Thus, a conductor film including the Al alloy film 12 and the titanium nitride film 14 sequentially laminated thereon is formed. Further, the Al alloy film 12 is an alloy film of Al and Cu, for example, containing 0.1 to 5% of Cu.

Then, the conductor film is patterned by photolithography and dry etching. Thus, a wiring 16 including the Al alloy film 12 and the titanium nitride film 14 is formed.

Subsequently, a silicon oxide film 18, for example, having a film thickness of about 500 nm, is formed on the front face, for example, by a CVD method.

Then, the surface of the silicon oxide film 18 is polished and the surface of the silicon oxide film 18 is smoothened, for example, by a CMP (Chemical Mechanical Polishing, chemically targeted mechanic polishing) method (see FIG. 4(*a*)).

Then, a photoresist film having a via pattern is formed on the silicon oxide film 18 by photolithography. Subsequently, the silicon oxide film 18 is etched by dry etching using a plasma with this photoresist film as a mask. At this time, the upper portion of the titanium nitride film 14 under the silicon oxide film 18 is also etched. Thus, a via hole (via pattern) 20 reaching the titanium nitride film 14 of the wiring 16 is formed on the silicon oxide film 18 (see FIG. 4(*b*)). The dry etching of the silicon oxide film 18 and the upper portion of the titanium nitride film 14 can be carried out, respectively, using a known method.

Then, the photoresist film used as a mask is removed by ashing using a plasma. The ashing of the photoresist film can be carried out using a known method.

In the dry etching for forming the via hole 20 and the ashing for removing the photoresist film, the residues (plasma etching residues and/or ashing residues) derived from the deformed photoresist film, the silicon oxide film 18, and the titanium nitride film 14 exposed on the bottom of the via hole 20 are adhered onto the substrate surface including the surface around the via hole 20.

Thus, after the ashing for removing the photoresist film, the semiconductor substrate 10 on which the via hole 20 is formed at last is cleaned by the cleaning composition of the present invention. Thus, the plasma etching residues and/or the ashing residues adhered on the surface of the semiconductor substrate 10 on which the via hole 20 is formed at last are removed.

Then, a tungsten film is formed on the front face, for example, by a CVD method.

Subsequently, the tungsten film is polished, for example, by a CMP method until the surface of the silicon oxide film 18 is exposed. Thus, a via including tungsten is embedded in the via hole 20.

Third Embodiment

Next, the outline of method for producing a semiconductor device according to the third embodiment of the present invention is similarly described with reference to FIG. 4.

The method for producing a semiconductor device according to the third embodiment of the present invention is different from the method for producing a semiconductor device according to the second embodiment, in that a via hole 22 reaching the Al alloy film 12 of the wiring 16 is formed.

First, in the same manner as the method for producing a semiconductor device according to the second embodiment, the wiring 16 including the Al alloy film 12 and the titanium nitride film 14, and the silicon oxide film 18 are formed on the semiconductor substrate 10 (see FIG. 4(*a*)).

Then, a photoresist film having a via pattern is formed on the silicon oxide film 18 by photolithography. Subsequently, the silicon oxide film 18 and the titanium nitride film 14 are etched by dry etching using a plasma with this photoresist film as a mask. At this time, the upper portion of the Al alloy film 12 under the titanium nitride film 14 is also etched. Thus, the via hole 22 (via pattern) reaching the Al alloy film 12 of the wiring 16 is formed on the silicon oxide film 18 and the titanium nitride film 14 (see FIG. 4(*c*)). The dry etching of the silicon oxide film 18, the titanium nitride film 14, and the upper portion of Al alloy film 12 can be carried out, respectively, using a known method.

Then, the photoresist film used as a mask is removed by ashing using a plasma. The ashing of the photoresist film can be carried out using a known method.

In the case of the present embodiment, in the dry etching for forming the via hole 22 and the ashing for removing the photoresist film, the plasma etching residues and/or the ashing residues are adhered onto the substrate surface including the surface around the via hole 22 and the wall surface of the via hole 22. In the case of the present embodiment, the plasma etching residues and/or the ashing residues are also derived from the Al alloy film 12 exposed to the bottom of the via hole 22 as well as the deformed photoresist film, the silicon oxide film 18, and the titanium nitride film 14.

Thus, after the ashing for removing the photoresist film, the semiconductor substrate 10 on which the via hole 22 is formed at last is cleaned by the cleaning composition of the present invention. Thus, the plasma etching residues and/or the ashing residues adhered on the surface of the semiconductor substrate 10 on which the via hole 22 is formed at last are removed.

Then, a via embedded in the via hole 22 is formed in the same manner as the method for producing a semiconductor device according to the first embodiment.

Fourth Embodiment

Next, an outline of the method for producing a semiconductor device according to the fourth embodiment of the present invention will be described with reference to FIG. 5.

FIG. 5 is a step cross-sectional view showing the outline in still another embodiment (the fourth embodiment) of the method for producing a semiconductor device of the present invention.

In the method for producing a semiconductor device according to the fourth embodiment of the present invention, an opening exposing the pad (pad electrode) formed on the uppermost portion in the multilayer wiring structure on the semiconductor substrate is formed on insulating film such as a passivation film and the like.

A wiring pattern is formed in the laminated interlayer insulating film which is laminated in the multilayer wiring structure formed on the semiconductor substrate. Further, the via connecting between the wiring patterns is suitably formed in the interlayer insulating film.

FIG. 5(*a*) shows an example of the uppermost portion of the multilayer wiring structure in which the pad is formed at last. As shown, a wiring pattern 44 is formed in the interlayer insulating film 38 formed on the semiconductor substrate (not shown). The wiring pattern 44 has a barrier metal film 40 such as a TiN film, a Ti film, and the like, and an Al film 42 covering the barrier metal film 40.

An interlayer insulating film 46 is formed on the interlayer insulating film 38 on which the wiring pattern 44 is formed. The via 52 connected to the wiring pattern 44 is formed in the interlayer insulating film 46. The via 52 has a barrier metal film 48 such as a titanium nitride film and the like, and a tungsten film 50 covering the barrier metal film 48.

A pad (pad electrode) 60 connected to the wiring pattern 44 through the via 52 is formed on the interlayer insulating film 46 on which the via 52 is formed. The pad 60 has an adhesion film 54, an Al film 56, and an adhesion film 58, sequentially laminated. The adhesion films 54 and 58 have a laminated structure of titanium/titanium nitride or a monolayer structure of titanium nitride.

Thus, a silicon oxide film 62 is formed on the interlayer insulating film 46 on which the pad 60 is formed, for example, by a high-density plasma CVD method (see FIG. 5(*b*)).

Then, a passivation film 64 including the silicon nitride film 18 is formed on the silicon oxide film 62, for example, by a plasma CVD method (see FIG. 5(*c*)).

Then, a photoresist film (not shown) exposing the opening-forming area reaching the pad 60 is formed on the passivation film 64 by photolithography. Subsequently, the passivation film 64 and the silicon oxide film 62 are etched by dry etching using a plasma with this photoresist film as a mask. At this time, the upper portions of the adhesion film 58 and the Al film 56 of the pad 60 can also be etched. Thus, the opening 66 exposing the pad 60 is formed on the passivation film 64 and the silicon oxide film 62 (see FIG. 5(*d*)). The dry etching of the passivation film 64 and the silicon oxide film 62 can be carried out, respectively, using a known method.

Then, the photoresist film used as a mask is removed by ashing using a plasma. The ashing of the photoresist film can be carried out using a known method.

In the formation of the photoresist film for forming the opening 66, the dry etching of the passivation film 64 and the silicon oxide film 62, and the ashing for removing the photoresist film, the residues (plasma etching residues and/or ashing residues) are adhered onto the substrate surface including the surface around the opening 66. These residues are derived from the photoresist film, the passivation film 64, the silicon oxide 62, the adhesion film 58, the Al film 56, and the like.

Thus, after the ashing for removing the photoresist film, the semiconductor substrate on which the opening 66 exposing the pad 60 is formed at last is cleaned by the cleaning composition of the present invention. Thus, the plasma etching residues and/or the ashing residues adhered on the surface of the semiconductor substrate on which the opening 66 is formed at last are removed.

The plasma etching residues and/or ashing residues formed on a semiconductor substrate in the formation of the above-described via hole or wiring as well as the plasma etching residues and/or the ashing residues formed on the semiconductor substrate in the formation of the opening exposing the pad can be sufficiently cleaned and removed by means of the cleaning composition of the present invention.

Furthermore, a case of forming the wiring 16 including the Al alloy film 12 is described in the above embodiment, but the materials for the wiring are not limited to those described above. As the wiring, a wiring having Cu including Cu or a Cu alloy as a main component can be formed, in addition to a wiring having Al including Al or an Al alloy as a main component.

In addition, a case of forming the pad 60 having the adhesion film 54, the Al film 56, and the adhesion film 58, sequentially laminated, is described in the above embodiment, but the materials for the pad are not limited to those described above. As the material for the pad, various metal materials can be used. Further, a case in which the opening 66 exposing the pad 60 to the passivation film 64 including the silicon nitride film, and the silicon oxide film 62 is formed is described above, but the insulating film which forms an opening exposing the pad is not also limited to these. As this insulating film, various insulating films can be used.

Furthermore, the cleaning composition of the present invention can be widely used in the step of cleaning the plasma etching residues and/or the ashing residues from the semiconductor substrate including aluminum (Al), copper (Cu), and/or tungsten (W), and the aluminum, copper, and/or tungsten is/are preferably included in a wiring structure formed on the semiconductor substrate.

EXAMPLES

Hereinafter, the present invention will be described in more detail with reference to Examples. However, the present invention is not limited to these Examples.

<Observation of Residue by Scanning Electron Microscope>

With regard to the first embodiment, after forming the wiring and before cleaning using the cleaning composition of the present invention, the patterned wafer was observed using a scanning electron microscope (SEM), and plasma etching residues and ashing residues were recognized on the upper face and the side face of the wiring.

With regard to the second and third embodiments, after forming the via hole and before cleaning using the cleaning composition of the present invention, the patterned wafers were observed using an SEM, and the plasma etching residue and ashing residue were recognized on the via hole wall surface in both cases.

Furthermore, with regard to the fourth embodiment, after forming the opening exposing the pad and before cleaning using the cleaning composition of the present invention, the patterned wafer was observed using an SEM, and plasma etching residue and ashing residue were recognized on the side face of the opening and the upper face of the insulating film around the opening.

Examples 1 to 31 and Comparative Examples 1 to 6

The cleaning compositions 1 to 37 (Examples 1 to 31 and Comparatives Examples 1 to 6) having the compositions shown in Table 1 below were each prepared (abbreviation of "Example" will be "Ex." and abbreviation of "Comparative Example" will be "Comp. Ex.".).

As the cleaning target, a patterned wafer after forming an aluminum wiring pattern by plasma etching and ashing, a patterned wafer after forming a pattern of the via hole by plasma etching and ashing, and a patterned wafer after forming an opening exposing the pad by plasma etching and ashing were prepared.

A piece (about 2.0 cm×2.0 cm) of the prepared patterned wafer was immersed in each cleaning composition warmed to 70° C. for 15 minutes, and then the piece of the patterned wafer was taken out, immediately washed with ultra-pure water for 1 minute, and then dried with $N_2$.

The surface of the piece of the patterned wafer after the immersion test was observed using an SEM, and evaluated in terms of the removability of the plasma etching residues and the ashing residues (cleanability) in accordance with the evaluation criteria described below. Further, for the wiring pattern, the removability of residues on the side face and the upper face of the wiring was evaluated. Also, for the pattern of the via hole, the removability of residues around the via hole was evaluated. In addition, for the pad pattern in which the opening exposing the pad was formed, the removability of residues around the side face of the opening and the upper face of the insulating film around the opening were evaluated.

Furthermore, by observation by means of an SEM, for the wiring pattern, the corrosion (recess) of the Al and the corrosion of the W (W plug) were evaluated, and for the via pattern, the corrosion of the Al of the wiring exposed to the lower portion of the via hole was evaluated.

The evaluation criteria are shown below. Further, the evaluation results are shown in Table 2.

<Removability of Residue (Cleanability)>

5: The residue was completely removed.

4: The residue was almost completely removed.

3: The residue was incompletely dissolved and 25% or more of the residue remained.

2: The residue was incompletely dissolved and 50% or more of the residue remained.

1: The residue was hardly removed.

Note that, the evaluation criteria for the cleanability are the same as for the residues on the side face and the upper face of the wiring in the wiring pattern, the residues around the via hole in the via pattern, and the residues on the side face and the upper face of the pad section in the pad pattern.

<Corrosion of Al>

5: Corrosion of Al was not observed.

4: Corrosion of Al was observed at 5% or less for wiring.

3: Corrosion of Al was observed at more than 5% to 10% or less for wiring.

2: Corrosion of Al was observed at more than 10% to 20% or less for wiring.

1: Al wiring was completely dissolved.

Note that, the evaluation criteria for the corrosion are the same as for Al in the wiring pattern and Al of the lower portion of the via hole in the via pattern.

<Corrosion of W (W Plug) in Wiring Pattern>

5: Corrosion of W was not observed.

4: Corrosion of W was observed at 25% or less for wiring.

3: Corrosion of W was observed at more than 25% to 50% or less for wiring.

2: Corrosion of W was observed at more than 50% to 80% or less for wiring.

1: W was completely dissolved.

In the evaluation above, a larger number as the evaluation result is better.

TABLE 1

| | | Component b | | Component c | | | Component e | | Component f | | |
|---|---|---|---|---|---|---|---|---|---|---|---|
| | Component a Compound | Compound | Content (% by weight) | Compound | Content (% by weight) | Component d Compound | Compound | Content (% by weight) | Compound | Content (% by weight) | pH |
| Ex. 1 | Water | F2 | 1.0 | HAS | 4 | TMAH | CA | 2.0 | DPG | 5 | 6.2 |
| Ex. 2 | Water | F1 | 1.5 | HAS | 2 | TMAH | GA | 1.0 | BD | 7 | 7.6 |
| Ex. 3 | Water | F1 | 2.0 | HAS | 5 | TMAH | MNA | 0.5 | Pin | 10 | 7.4 |
| Ex. 4 | Water | F5 | 2.1 | HAS | 10 | TMAH | VA | 4.0 | MPD | 20 | 7.0 |

TABLE 1-continued

| | Component a | Component b | | Component c | | Component d | Component e | | Component f | | |
|---|---|---|---|---|---|---|---|---|---|---|---|
| | Compound | Compound | Content (% by weight) | Compound | Content (% by weight) | Compound | Compound | Content (% by weight) | Compound | Content (% by weight) | pH |
| Ex. 5 | Water | F7 | 3.0 | HAS | 10 | TMAH | OA | 2.0 | DPG | 13 | 8.2 |
| Ex. 6 | Water | F8 | 4.0 | HAS | 2 | TBAH | GA | 3.0 | Gly | 16 | 8.5 |
| Ex. 7 | Water | F9 | 2.4 | HAS | 2 | BTMAH | CA | 0.5 | DPG | 4 | 7.8 |
| Ex. 8 | Water | F2 | 1.6 | HAS | 3 | BTMAH | MLA | 1.0 | MPD | 8 | 7.8 |
| Ex. 9 | Water | F6 | 1.7 | HAS | 6 | TMAH | AA | 1.5 | DPG | 11 | 8.2 |
| Ex. 10 | Water | F9 | 2.0 | HAS | 4 | TMAH | GTA | 1.6 | Gly | 16 | 6.9 |
| Ex. 11 | Water | F1 | 3.0 | HAS | 8 | TMAH | IVA | 2.3 | Gly | 30 | 7.1 |
| Ex. 12 | Water | F8 | 3.4 | HAS | 2 | TBAH | FA | 2.4 | CHD | 12 | 7.6 |
| Ex. 13 | Water | F5 | 5.0 | HAS | 5 | TMAH | SUA | 1.6 | CHD | 16 | 7.7 |
| Ex. 14 | Water | F5 | 1.6 | HAS | 4 | TMAH | TA | 1.0 | DPG | 14 | 6.1 |
| Ex. 15 | Water | F5 | 2.9 | HAS | 5 | TMAH | MA | 0.5 | Pin | 16 | 6.3 |
| Ex. 16 | Water | F4 | 6.0 | HAS | 5 | TMAH | BCA | 1.0 | Gly | 20 | 6.0 |
| Ex. 17 | Water | F3 | 4.5 | HAS | 2 | TMAH | LA | 1.0 | DPG | 12 | 6.5 |
| Ex. 18 | Water | F7 | 0.5 | HAS | 3 | TMAH | PHA | 2.0 | CHD | 34 | 7.8 |
| Ex. 19 | Water | F11 | 8.1 | HAS | 3 | TMAH | SA | 5.0 | DPG | 14 | 8.0 |
| Ex. 20 | Water | F6 | 2.1 | HAS | 4 | TMAH | GLA | 2.0 | APO | 13 | 7.1 |
| Ex. 21 | Water | F12 | 3.0 | HAS | 3 | TMAH | AA | 5.0 | MPD | 11 | 8.0 |
| Ex. 22 | Water | F13 | 1.0 | HAS | 3 | TMAH | AA | 5.0 | MPD | 11 | 7.4 |
| Ex. 23 | Water | F14 | 0.5 | HAS | 3 | TBAH | LA | 5.0 | BO | 11 | 7.9 |
| Ex. 24 | Water | F8 | 1.0 | HAS | 6 | TMAH | CA | 3.0 | PGME | 14 | 8.3 |
| Ex. 25 | Water | F2 | 2.0 | HAS | 4 | TBAH | GA | 1.0 | DEG | 11 | 6.2 |
| Ex. 26 | Water | F9 | 2.3 | HAS | 0.5 | TMAH | SA | 5.0 | MPD | 11 | 7.9 |
| Ex. 27 | Water | F6 | 1.3 | HAS | 7 | TMAH | CA | 4.0 | MPD | 50 | 7.0 |
| Ex. 28 | Water | F8 | 1.9 | HAS | 6 | TMAH | FRA | 2.0 | MPD | 8 | 8.1 |
| Ex. 29 | Water | F15 | 2.0 | HAS | 3 | TBAH | SA | 4.0 | BD | 5 | 7.5 |
| Ex. 30 | Water | F16 | 2.5 | HAS | 5 | TMAH | CA | 3.0 | DPG | 10 | 7.4 |
| Ex. 31 | Water | F17 | 3.2 | HAS | 6 | TMAH | PA | 1.0 | Gly | 7 | 7.8 |
| Comp. Ex. 1 | Water | F7 | 5.0 | — | — | TMAH | LA | 2.0 | APO | 6 | 7.6 |
| Comp. Ex. 2 | Water | F4 | 2.6 | HAS | 4 | TBAH | GA | 1.0 | DPG | 11 | 4.9 |
| Comp. Ex. 3 | Water | F3 | 6.4 | HAS | 5 | TMAH | TA | 4.0 | CHD | 8 | 10.0 |
| Comp. Ex. 4 | Water | F9 | 5.9 | HAS | 4 | TBAH | — | — | Gly | 11 | 7.9 |
| Comp. Ex. 5 | Water | — | — | HAS | 3 | TMAH | AA | 5.0 | MPD | 11 | 7.2 |
| Comp. Ex. 6 | Water | F2 | 2.0 | HAS | 2 | TMAH | LA | 2.0 | — | — | 7.3 |

The content of each component in Table 1 represents % by weight based on the total weight of the cleaning composition.

Furthermore, the content of the component a in Table 1 above is the balance when the sum of each of the components a through f becomes 100% by weight.

Moreover, the content of the component d is an amount corresponding to a value of the pH shown in Table 1. Further, the content of the component d in each Example and each Comparative Example is in the range of 1 to 10% by weight based on the total weight of the cleaning composition, and an amount corresponding to a value of the pH shown in Table 1 of the component d was added.

Furthermore, the compounds represented by the abbreviations in Table 1 above are as follows.

(Component b)

F1: diethylamine, F2: n-butylamine, F3: 3-methoxypropylamine, F4: tert-butylamine, F5: benzylamine, F6: n-hexylamine, F7: cyclohexylamine, F8: n-octylamine, F9: 2-ethylhexylamine, F10: N-methyl-N-butylamine, F11: N-(3-aminopropyl)morpholine, F12: 2-aminoethanol, F13: polyethyleneimine, F14: n-dodecylamine, F15: o-xylenediamine, F16: m-xylenediamine, F17: p-xylenediamine.

(Component c)

HAS: hydroxylammonium sulfate.

(Component d)

TMAH: tetramethylammonium hydroxide, TBAH: tetrabutylammonium hydroxide, BTMAH: benzyltrimethylammonium hydroxide.

(Component e)

CA: citric acid, GA: glycolic acid, LA: lactic acid, MNA: malonic acid, OA: oxalic acid, AA: acetic acid, PA: propionic acid, VA: valeric acid, IVA: isovaleric acid, SUA: succinic acid, MA: malic acid, GTA: glutaric acid, MLA: maleic acid, FA: fumaric acid, PHA: phthalic acid, BCA: 1,2,3-benzenetricarboxylic acid, SA: salicylic acid, TA: tartaric acid, GLA: gluconic acid, FRA: formic acid (Component f)

CHD: 1,2-cyclohexanediol, MPD: 2-methyl-2,4-pentanediol, BD: 1,3-butanediol, BO: 2-butanol, DPG: dipropylene glycol (1,1'-oxybis(2-propanol)), Pin: pinacol, Gly: glycerin, APO: 1-amino-2-propanol, PGME: 2-methoxy-1-propanol, DEG: diethylene glycol

TABLE 2

| | Wiring pattern | | | Via pattern | | Pad pattern |
|---|---|---|---|---|---|---|
| | Removal of residue on side face and upper face of wiring | Al corrosion (recess) | Corrosion of W plug | Removal of residue around via hole | Al corrosion on lower portion of via hole | Removal of residue on side face and upper face of pad section |
| Ex. 1 | 5 | 5 | 5 | 5 | 5 | 5 |
| Ex. 2 | 5 | 4 | 5 | 5 | 5 | 5 |
| Ex. 3 | 4 | 5 | 5 | 4 | 4 | 4 |
| Ex. 4 | 4 | 5 | 4 | 4 | 5 | 4 |
| Ex. 5 | 4 | 4 | 4 | 5 | 4 | 5 |
| Ex. 6 | 4 | 5 | 5 | 4 | 4 | 4 |
| Ex. 7 | 5 | 5 | 5 | 5 | 5 | 5 |
| Ex. 8 | 4 | 4 | 4 | 4 | 4 | 4 |
| Ex. 9 | 4 | 4 | 5 | 4 | 5 | 4 |
| Ex. 10 | 5 | 5 | 5 | 5 | 5 | 5 |
| Ex. 11 | 4 | 4 | 4 | 4 | 4 | 4 |
| Ex. 12 | 5 | 4 | 5 | 5 | 5 | 4 |
| Ex. 13 | 4 | 4 | 5 | 4 | 4 | 5 |
| Ex. 14 | 4 | 4 | 4 | 5 | 4 | 4 |
| Ex. 15 | 5 | 5 | 4 | 4 | 5 | 4 |
| Ex. 16 | 4 | 4 | 4 | 4 | 4 | 5 |
| Ex. 17 | 5 | 5 | 4 | 4 | 4 | 4 |
| Ex. 18 | 4 | 4 | 4 | 5 | 5 | 4 |
| Ex. 19 | 4 | 5 | 5 | 5 | 5 | 5 |
| Ex. 20 | 5 | 5 | 5 | 4 | 4 | 4 |
| Ex. 21 | 4 | 4 | 4 | 5 | 4 | 4 |
| Ex. 22 | 4 | 4 | 4 | 4 | 4 | 5 |
| Ex. 23 | 4 | 4 | 4 | 4 | 5 | 4 |
| Ex. 24 | 4 | 5 | 4 | 4 | 4 | 2 |
| Ex. 25 | 4 | 4 | 5 | 5 | 4 | 3 |
| Ex. 26 | 3 | 4 | 3 | 2 | 4 | 4 |
| Ex. 27 | 2 | 4 | 4 | 2 | 4 | 4 |
| Ex. 28 | 5 | 2 | 3 | 4 | 4 | 4 |
| Ex. 29 | 4 | 2 | 3 | 4 | 4 | 4 |
| Ex. 30 | 5 | 5 | 5 | 5 | 5 | 5 |
| Ex. 31 | 4 | 3 | 3 | 4 | 3 | 4 |
| Comp. Ex. 1 | 1 | 3 | 3 | 1 | 3 | 1 |
| Comp. Ex. 2 | 3 | 3 | 3 | 2 | 2 | 2 |
| Comp. Ex. 3 | 3 | 1 | 1 | 3 | 1 | 4 |
| Comp. Ex. 4 | 1 | 3 | 2 | 4 | 3 | 4 |
| Comp. Ex. 5 | 3 | 3 | 1 | 3 | 3 | 3 |
| Comp. Ex. 6 | 5 | 4 | 2 | 4 | 4 | 1 |

What is claimed is:

1. A cleaning composition for removing plasma etching residues and/or ashing residues formed on a semiconductor substrate, which includes:

(Component a) water;

(Component b) an amine compound;

(Component c) hydroxylamine sulfate;

(Component d) a quaternary ammonium compound;

(Component e) an organic acid; and (Component f) a water-soluble organic solvent; and has a pH of 6 to 9, wherein the component b is at least one compound selected from the group consisting of 2-ethylhexylamine, n-butylamine, 3-methoxypropylamine, tert-butylamine, benzylamine, n-hexylamine, cyclohexylamine, n-octylamine, N-methyl-N-butylamine, N-(3-aminopropyl) morpholine, 2-aminoethanol, o-xylenediamine, m-xylenediamine, p-xylenediamine, and n-dodecylamine.

2. The cleaning composition as set forth in claim 1, wherein the component d is tetraalkylammonium hydroxide.

3. The cleaning composition as set forth in claim 1, wherein the component e is at least one compound selected from the group consisting of lactic acid, citric acid, formic acid, oxalic acid, acetic acid, propionic acid, malonic acid, succinic acid, glutaric acid, maleic acid, fumaric acid, phthalic acid, glycolic acid, gluconic acid, salicylic acid, tartaric acid, and malic acid.

4. The cleaning composition as set forth in claim 1, wherein the component e is a carboxylic acid having a hydroxyl group.

5. The cleaning composition as set forth in claim 1, wherein the component f is at least one compound selected from the group consisting of dipropylene glycol, 2-methyl-2,4-pentanediol, 1,3-butanediol, 1,2-cyclohexanediol, 2-butanol, 2,3-dimethyl-2,3-butanediol, glycerin, propylene glycol monomethyl ether, and diethylene glycol.

6. The cleaning composition as set forth in claim 1, wherein the plasma etching residues and/or the ashing residues are residues including at least one metal selected from the group consisting of aluminum, copper, and tungsten.

7. The cleaning composition as set forth in claim 1, which is used for removing plasma etching residues and ashing residues.

8. The cleaning composition as set forth in claim claim 1, wherein the component b is at least one compound selected from the group consisting of o-xylenediamine, m-xylenediamine, and p-xylenediamine.

9. The cleaning composition as set forth in claim 1, wherein the component f in the cleaning composition is 1 to 25% by weight, based on the total weight of the cleaning composition.

10. The cleaning composition as set forth in claim 1, wherein the component a in the cleaning composition is 70 to 95% by weight, based on the total weight of the cleaning composition.

11. A method for producing a semiconductor device, including:

an etching step of carrying out plasma etching for a semiconductor substrate; and/or an ashing step of carrying out ashing for the semiconductor substrate; and a cleaning step of cleaning the plasma etching residues and/or the ashing residues formed on the semiconductor substrate in the etching step and/or the ashing step, by means of the cleaning composition for removing plasma etching residues and/or ashing residues formed on a semiconductor substrate, which includes:

(Component a) water, (Component b) an amine compound, (Component c) hydroxylamine sulfate, (Component d) a quaternary ammonium compound, (Component e) an organic acid, and (Component f) a water-soluble organic solvent, and has a pH of 6 to 9, wherein the component b is at least one compound selected from the group consisting of 2-ethylhexylamine, n-butylamine, 3-methoxypropylamine, tert-butylamine, benzylamine, n-hexylamine, cyclohexylamine, n-octylamine, N-methyl-N-butylamine, N-(3-aminopropyl) morpholine, 2-aminoethanol, o-xylenediamine, m-xylenediamine, p-xylenediamine, and n-dodecylamine.

12. The method for producing a semiconductor device as set forth in claim 11, wherein the semiconductor substrate includes aluminum, copper, and/or tungsten.

13. A cleaning method including:

a preparation step of preparing a cleaning composition for removing plasma etching residues and/or ashing residues formed on a semiconductor substrate; and a cleaning step of cleaning the plasma etching residues and/or ashing residues formed on a semiconductor substrate by means of the cleaning composition, wherein the cleaning composition includes:

(Component a) water, (Component b) an amine compound, (Component c) hydroxylamine sulfate, (Component d) a quaternary ammonium compound, (Component e) an organic acid, and (Component f) a water-soluble organic solvent, and has a pH of 6 to 9, wherein the component b is at least one compound selected from the group consisting of 2-ethylhexylamine, n-butylamine, 3-methoxypropylamine, tert-butylamine, benzylamine, n-hexylamine, cyclohexylamine, n-octylamine, N-methyl-N-butylamine, N-(3-aminopropyl) morpholine, 2-aminoethanol, o-xylenediamine, m-xylenediamine, p-xylenediamine, and n-dodecylamine.

14. The cleaning method as set forth in claim 13, wherein the semiconductor substrate includes aluminum, copper, and/or tungsten.

* * * * *